United States Patent [19]

Cupit

[11] 4,333,660

[45] Jun. 8, 1982

[54] SEAL DEVICE FOR PIPE PROJECTING THROUGH ROOF

[76] Inventor: George M. Cupit, 5 Waldheim Rd., Bayswater, Victoria, Australia

[21] Appl. No.: 126,200

[22] Filed: Mar. 3, 1980

Related U.S. Application Data

[63] Continuation of Ser. No. 870,102, Jan. 17, 1978, abandoned.

[30] Foreign Application Priority Data

Jan. 17, 1977 [AU] Australia ..... PC 8770

[51] Int. Cl.[3] ..... F16L 41/06; F16J 15/00

[52] U.S. Cl. ..... 277/9; 52/60; 285/42

[58] Field of Search ..... 285/3, 4, 42, 43, 44, 285/58, 59, 60, 199; 277/9

[56] References Cited

U.S. PATENT DOCUMENTS

| | | | |
|---|---|---|---|
| 1,512,672 | 10/1924 | Blauvelt | 285/44 |
| 3,410,037 | 11/1968 | Empson et al. | 52/58 |
| 3,731,952 | 5/1973 | Elwart | 285/44 |
| 3,866,950 | 2/1975 | Skoch et al. | 285/4 |
| 3,977,137 | 8/1976 | Patry | 52/60 |

*Primary Examiner*—William Price

*Attorney, Agent, or Firm*—Bucknam and Archer

[57] ABSTRACT

A seal device to provide a fluid seal between a conduit or the like and a surface through which the conduit extends comprising a non-resilient annular metal base member deformable to complement the surface to which it is to be fitted, and a sleeve of resilient material integral with the base at one end and apertured at the other end to receive in sealing relation the conduit, the resilient material of the sleeve extending across the face of the base to provide in use a sealing element between the base member and the surface to which it is to be fitted.

6 Claims, 4 Drawing Figures

SEAL DEVICE FOR PIPE PROJECTING THROUGH ROOF

This is a continuation of application Ser. No. 870,102 filed Jan. 17, 1978, and now abandoned.

This invention relates to a seal device to be used in providing a fluid seal between an elongate member such as a pipe or duct and a surface such as a wall or roof of a building through which the elongate member projects.

In the following discussion, particular reference will be made to the use of the seal device to provide a weather tight seal between a pipe or vent extending through the roof of a building, however it is to be understood that this particular application of the seal device is not limiting on the invention and that the device has a much wider field of application.

There are currently known a variety of means for creating a seal between a roof and a pipe or vent extending therethrough, however the majority of these require varying degrees of fabrication on the site and also a high degree of skill in order to ensure an effective seal is obtained. The most popular sealing arrangement currently used is to fabricate from one or more pieces of light gauge sheet material a plate which can be secured such as by soldering or pop riveting to the roof and to beat or otherwise form about an aperture in the plate an upstanding flange to engage the external surface of the pipe or vent, the flange being soldered or otherwise sealed to this external surface. In applications where the roof is of a tiled or slate construction the flat plate is beaten or formed into a contour to mate with the surrounding slates or tiles so that water flowing thereover will not enter beneath the plate.

In all of these known devices considerable skill is required on the part of the workman to achieve an effective seal and also the fabrication and fitting of the seal device is relatively time consuming and therefore expensive.

It is therefore the object of the present invention to provide a seal device which can be pre-manufactured under high volume manufacturing techniques and can be quickly and simply fitted by a relatively unskilled person. It is also important for the seal device to be useable in a variety of applications particularly in regard to different contours of roofing or sheeting without requiring modification or special skill.

With this object in view the present invention envisages a seal device to provide a fluid seal between an elongate member and a surface through which the elongate member projects comprising a base member for securement to the surface, said base member being of a non-resilient deformable nature so that in use it may be deformed to complement the contour of the surface, a resilient flexible member having an aperture to receive the elongate member in sealed engagement, the resilient member being connected in sealed relation to the base member to accommodate in use misalignment between the elongate member, the apertured resilient member and the base member.

More specifically there is provided a seal device to provide a fluid seal between an elongate member and a surface through which the elongate member projects comprising, a tubular member having a free end defining an aperture proportioned to resiliently expand to receive the elongate member whereby in use said free end of the tubular member sealable engages the external surface of the elongate member, a flexible non-resilient annular base member deformable in use to complement the contour of the surface, said base member being disposed about the axis of the tubular member and spaced axially from said free end, and a non planar continuous skirt of resilient material about the periphery of the tubular member and integral with the base member and tubular member, said skirt being constructed to provide a resilient sealed connection between the tubular and base members and to accommodate in use movement of the tubular member to align said opening with the elongate member.

Preferably the surface of the base member which in use engages the surface to which the seal device is to fixed is provided with a coating or a layer of compressible material which will provide a seal between the surface and the base member when in use. This coating may be in the form of a film of resilient material such as rubber or a suitable thermoplastic material. A series of ridges of the same general shape as the periphery of the base member may be provided on the sealing surface to firstly, provide areas of increased sealing pressure when the seal device is fitted and secondly, to provide between successive ridges, a recess or cavity to receive a flowable sealant material such as one of the commonly known mastic or silicon sealing compositions. The base member is fixed to the surface surrounding the elongate member by suitable fastening means such as pop rivets, althrough in some applications it may be desirable to use conventional rivets, screws or nuts and bolts. In order to assist in installation of the seal device the base member may be provided with a plurality of preformed holes to receive the rivets, screws or bolts.

Preferably the base member is made from light gauge material which is readily formable, preferably by hand pressure, and will retain the contour to which it is formed. Metal sheet, such as aluminium, is particularly suitable for the production of the base member although other metals such as stainless steel or galvanised or plated steel may be used.

In a most convenient form the tubular member and the skirt are moulded as a one piece component from a resilient flexible material, such as rubber or thermo-plastic, and in the moulding operation may be bonded directly to the base member of metal or other compatible material. Also in this moulding operation the surface layer of sealing material may be applied to the face of the base member which contacts the roof or like sheeting in use.

The non-planar skirt may take a variety of forms which will impart the necessary degree of flexibility to accommodate movement between the base member and the tubular member to permit alignment and correct sealing between the tubular member and the elongate member. The contour of the skirt is preferably in the form of a pleat or re-entrant fold, which provides a substantial degree of flexibility without substantial distortion of the tubular member. Subject to the actual size of the seal device, which is primarily determined by the cross-section of the elongate member, two or more pleats or folds may be provided in the skirt section, the pleats or folds being spaced from one another in the diametral direction of the tubular member and/or the axial direction thereof.

In order that one seal device may be used to accommodate a limited range of sizes of elongate members, the tubular member is tapered over at least part of its length, and may be cut off at an appropriate location to provide an opening of a diameter that upon resilient expansion to a suitable degree will receive the elongate member, and provide the necessary sealing engagement therebetween.

In the drawings—

Figure 1:
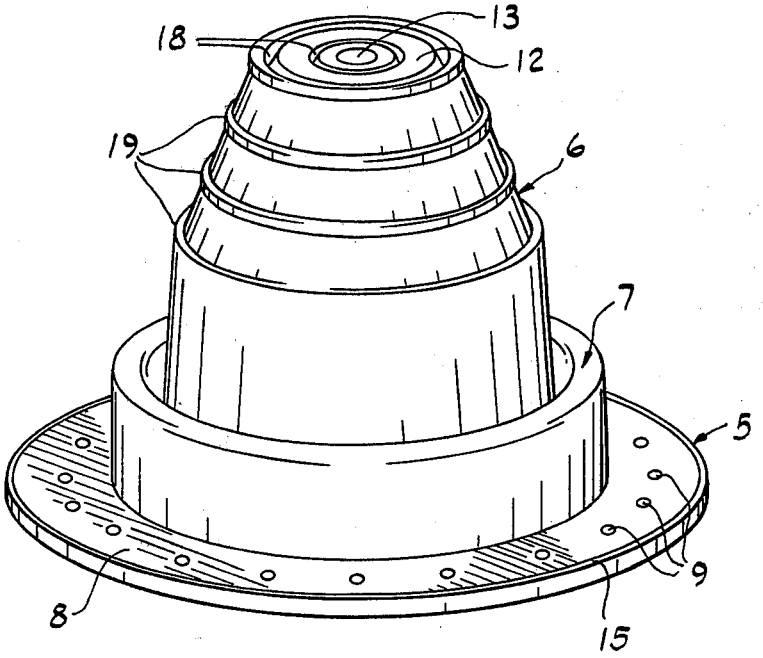
FIG. 1 is a perspective view of a seal device in accordance with the present invention.
Figure 3A:
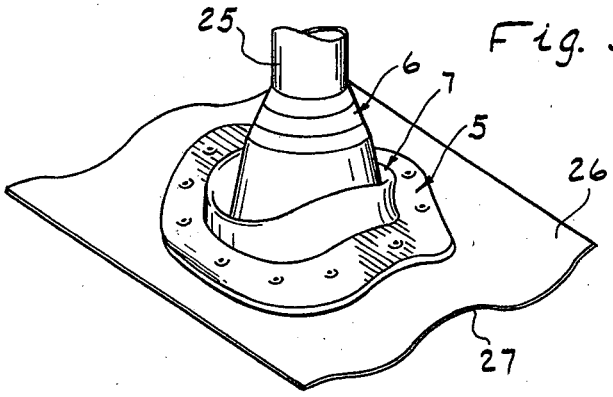
Figure 3B:
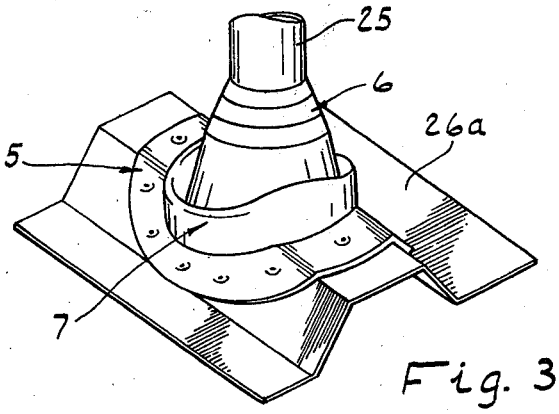

FIGS. 3*a* and 3*b* are perspective views of the seal device shown in FIG. 1 fitted to two sheets of different contours.

Figure 2:
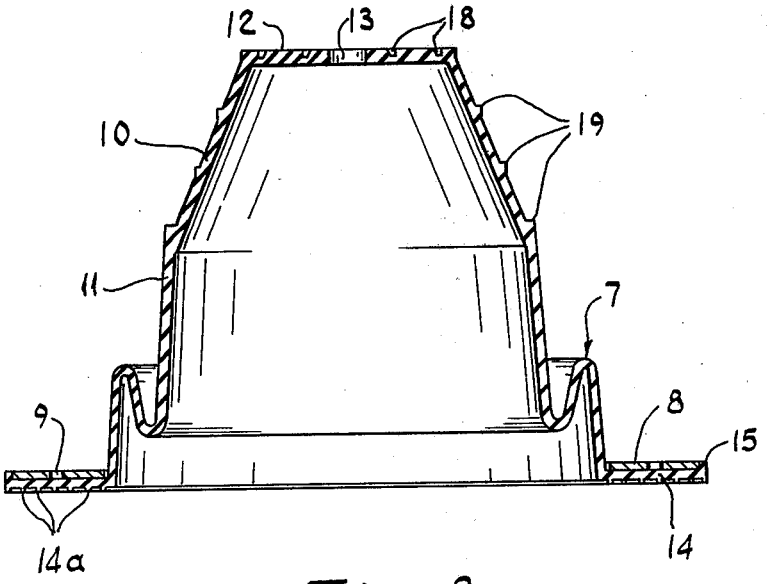
FIG. 2 is a diametral sectional view of the seal device shown in FIG. 1.

Referring now to FIGS. 1 and 2 the seal device comprises a base member 5 and a sleeve member 6 interconnected by a skirt section 7 integral with each.

The base member 5 comprises an upper annular 8 made of a non-resilient deformable material. Preferably the upper element 8 is made from light gauge metal sheet, such as aluminium, of the order of 22 gauge thick, and is thus readily deformably by hand and has negligible resilience. A plurality of apertures 9 are formed in the upper annular element 8 at a substantially equal spacing around a circle concentric with the axis of the annular element. The apertures are for the purpose of receiving fastenings such as rivets, screws or bolts to attach the sealing device to a sheet member.

The tubular member 6 has an upper truncated conical section 10 and a lower co-axial cylindrical section 11. The upper end of the truncated conical section 10 is closed by end portion 12 having a central aperture 13. The lower end of the cylindrical section 11 has formed integral therewith the skirt section 7 which at its lower end is integral with a flange element 14 bonded to the underface of the upper annular element 8. In the embodiment shown, the flange element 14 has an outer peripheral lip 15 surrounding the peripheral edge of the upper annular element 8.

The tubular member 6, the skirt 7 and the flange element 14 are formed in a single moulding operation, and preferably during this operation the flange element 14 is bonded to the upper element 8 so that the sealing device is of an integral construction.

The tubular member 6, skirt 7 and flange element 14 are formed from a flexible resilient material such as rubber or a thermoplastic material selected so that it will retain its resilient properties in the environment to which it is intended to be subjected in use. The major application for the sealing device is in relation to sealing vents or conduits extending through the roof or walls of buildings, and thus is exposed to a range of climatic conditions, including strong sunlight, flexible resilient material, particularly suitable for use in such conditions are ethylene propylene diene monomers and ethylene propylene terpolymer.

In the sealing device illustrated the skirt 17 is formed with a single circular pleat 17*a* which provides a substantial degree of flexibility between the base member 5 and the tubular member 6 to accommodate misalignment between the various components when in use as will be described in greater detail. When required a greater degree of flexibility can be obtained by using a multiple pleat construction.

The sealing device is intended to cover a range of conduit sizes and thus the aperture 13 is of a size which will receive in sealing engagement the smallest size conduit intended to be used. The upper end portion 12 is provided with two concentric grooves 18 which correspond to the size of aperture required to accommodate two further sizes of conduits. A workman may enlarge the size of the aperture 13 by cutting along either one of the grooves 18 to suit the particular size conduit. Larger sizes of conduit may be accommodated by cutting around the periphery of the truncated conical section 10 at appropriate locations, and as a guide in this cutting operation ridges 19 are provided on the external surface of the truncated conical section concentric with aperture 13.

The flange element 14 is formed with a plurality of concentric sealing ridges 14*a* on the under face thereof and the flange element closes the apertures 9 formed in the upper element 8. The closing of the apertures 9 by the coating of resilient material ensures that if fastenings devices are not fitted to all of the apertures provided, then leakage cannot occur through the remaining vacant apertures. Where the flange element 14 is of a significant thickness, apertures may be formed partway therethrough leaving only a thin membrane of resilient material closing the aperture. This construction simplifies the subsequent assembly operation as the fastening device can readily pierce the membrane and thus the difficulty normally encountered in drilling rubber or like resilient material is overcome.

It will be appreciated that the form of the base member being made of a deformable non-resilient material enables the workman to bend the base to any necessary contour to closely mate with the surface to which the device is to be fitted and once so deformed, the base member will retain this shape throughout the fitting operation thus leaving the workman's hands free to carry out the fitting operation. Also moulding a layer of resilient material to form the flange element on the face of the base member directed towards the surface to which it is to be fitted, ensures that when the metal portion of the base member is deformed, the sealing layer will naturally take up the same form, and will remain in the correct relationship to the metal part of the base member during the fitting operation.

Further as the pleated skirt 7 form the connection between the base member 5 and the sleeve member 6 the deforming of the base member results in little deformation of the sleeve member, particularly at the end which engages the elongate conduit. The deforming of the base member 5 therefore does not detract from the effectiveness of the seal between the sleeve member and the elongate conduit. The feature of the sealing device is illustrated in FIGS. 3*a* and 3*b*. As illustrated in FIG. 3*a* the seal device is fitted to a conduit 25 which extends through a standard type of corrugated sheet 26. The base member 5 of the seal device has been deformed to mate with the corrugation of the sheet 26. The deforming of the base member made be carried out by initially positioning the seal device on the conduit 25 and then riveting the base member at diametrically opposite locations to the ridge 27 of the sheet. The base member while secured to the sheet 26 is then deformed to closely fit the valleys on either side of the ridge 27 and the remaining rivets fitted.

In FIG. 3*b* there is illustrated the use of the seal device, as described with reference to FIGS. 1 and 2, on a ribbed sheet 26*a* such sheets being used or substantially flat roof. The seal device may be fitted is a similar manner to that described above with reference to FIG. 3*a*.

The base member 5 may be disposed in a plane inclined to the axis of the sleeve member 6 to reduce the amount of deflect of the skirt 7 necessary to align the sleeve member to the elongate conduit as the roof of a building must be inclined for drainage purposes.

I claim:

1. A seal device to provide a fluid seal between an elongate member and a non-planar surface through which the elongate member projects, comprising a base member capable of conforming attachment to the non-planar surface, said base member comprising an apertured metal outer flange element of non-resilient manually deformable nature so that in use it may be deformed to conform with the contour of the non-planar surface to which it is to be attached and will by itself generally retain such deformed contour and a complementary apertured sealing element of non-metallic resilient material with a flange portion secured in underlying relation to said metal outer flange element with respective apertures aligned and so as to be compressed between the metal outer flange element and the non-planar surface to which the device is to be attached in use to provide a seal therebetween, a sleeve member of non-metallic resilient material integral with the sealing element and projecting through the aperture in the metal outer flange element, said sleeve member when in use having at an end portion remote from the base member an aperture dimensioned to receive the elongate member in sealing engagement, the sleeve member between the said end portion and the base member being flexible to accommodate in use misalignment between the base member and the apertured portion of the sleeve, said metal outer flange element, when deformed to the contour of the non-planar surface to which it is attached, maintaining the flange portion of said sealing element in a similarly deformed contour to abut said non-planar surface in sealing engagement therewith.

2. A seal device to provide a seal between an elongate member and a non-planar surface through which the elongate member projects, which seal device comprises a generally non-resilient metal flange element and having an aperture, said flange element being manually deformable so that in use it may be deformed to conform with the contour of the non-planar surface to which the seal device is to be attached and will by itself generally retain such deformed contour; and a hollow, cup-shaped sealing element of a non-metallic resilient material and having a flange portion and a sleeve portion integrally connected to said flange portion by a reentrant skirt section, said skirt section being received through the aperture of the metal flange element, and said flange portion of the sealing element being secured to said metal flange element in underlying relation thereto, said sleeve portion having an end remote from said flange portion disposed to receive said elongate member in sealing engagement therewith when the seal device is in use.

3. A seal device according to claim 1 or claim 2 wherein the flange portion of said sealing element is bonded to said metal flange element.

4. A seal device according to claim 3 wherein said flange portion of the sealing element has at least one ridge projecting from a surface of said flange portion that will face said non-planar surface, said ridge aiding in establishing sealing engagement between said surface of the flange portion and said non-planar surface when the seal device is in use.

5. A seal device according to claim 3 wherein said sleeve portion of the sealing element is located radially inward with respect to the flange portion of the sealing element, and said reentrant skirt section extends circumferentially about said sleeve portion to connect same to said flange portion with a degree of flexibility accomodating a limited misalignment between the elongate member and said flange portion when the seal device is in use.

6. A seal device according to claim 3 wherein said sleeve portion of the sealing element has a tapered tubular portion and indicial markings thereon to locate where said tubular portion may be cut to receive in sealing engagement therewith an elongate member of predetermined diametral size.

* * * * *